US005428344A

United States Patent [19]

Curry et al.

[11] Patent Number: 5,428,344

[45] Date of Patent: * Jun. 27, 1995

[54] CRANE HOIST SAFETY DEACTIVATOR

[76] Inventors: John R. Curry, 419 E. Walnut Ave., El Segundo, Calif. 90245; Donald A. Chambers, 1190 W. Grant, Wilmington, Calif. 90744

[ * ] Notice: The portion of the term of this patent subsequent to Nov. 9, 2010 has been disclaimed.

[21] Appl. No.: 148,940

[22] Filed: Nov. 8, 1993

Related U.S. Application Data

[63] Continuation-in-part of Ser. No. 864,411, Apr. 6, 1992, Pat. No. 5,260,688.

[51] Int. Cl.[6] ..... G08B 1/08; B66C 13/18

[52] U.S. Cl. ..... 340/539; 340/673; 340/685; 212/276; 361/1

[58] Field of Search ..... 340/539, 685, 689, 679, 340/683, 673, 825.06, 725.69, 825.72; 212/149, 153, 156; 361/1; 192/129 R, 129 A, 116.5, 127, 125 A

[56] References Cited

U.S. PATENT DOCUMENTS

| | | | |
|---|---|---|---|
| 2,814,032 | 11/1957 | Agnew et al. | 340/685 |
| 3,823,395 | 7/1974 | Rigney et al. | 340/685 |
| 3,824,578 | 7/1974 | Harders | 340/685 |
| 3,956,742 | 5/1976 | Karl | 340/539 |
| 3,969,714 | 7/1976 | Greer | 340/685 |
| 4,003,482 | 1/1977 | Cheze | 212/149 |
| 4,238,037 | 12/1980 | Azovtsev | 212/149 |
| 4,350,254 | 9/1982 | Noly | 212/153 |
| 4,732,286 | 3/1988 | Koenig | 340/685 |
| 4,743,893 | 5/1988 | Gentile | 340/685 |
| 4,753,357 | 6/1988 | Miyoshi | 212/161 |
| 4,787,524 | 11/1988 | Cobb | 212/150 |
| 4,804,095 | 2/1989 | Rohr | 212/152 |
| 4,821,835 | 4/1989 | Latvys | 212/149 |
| 5,058,752 | 10/1991 | Wacht et al. | 212/150 |

*Primary Examiner*—Donnie L. Crosland
*Attorney, Agent, or Firm*—Fulwider, Patton, Lee & Utecht

[57] ABSTRACT

A safety apparatus for use on a hoisting crane used to hoist cargo from cargo transport trucks that detects hoisting such trucks and renders the hoisting mechanism inoperative. The safety apparatus includes sensors responsive to an unsafe condition in such trucks to generate a safety signal. A transmitter responsive to the safety signal transmits an operational signal to the hoisting crane that upon receiving and recognizing the operational signal renders the hoisting mechanism inoperative and alerts the crane operator of the unsafe condition.

21 Claims, 7 Drawing Sheets

CRANE HOIST SAFETY DEACTIVATOR

This is a continuation-in-part of application Ser. No. 07/864,411 filed on Apr. 6, 1992 now U.S. Pat. No. 5,260,688.

BACKGROUND OF THE INVENTION

1. Field of the Invention

The present invention relates generally to cargo transfer cranes and particularly to a hoisting crane for loading and unloading cargo ships.

2. Description of the Prior Art

It is well known that the cost of lay days for a ship in harbor for on loading or off loading can prove particularly expensive to a ship's owner. Consequently, various methods have been developed for expediting the on loading and off loading of ships. One such method contemplates the loading of pieces of cargo in large containers to be contained therein for transfer to and from the ship as a unit. These containers are then hoisted directly from the trailer at dock side by a gantry crane which then transfers them to the ship's hold.

The rate of compensation which must be made to longshoreman personnel and truckers providing the labor associated with maritime cargo transfer is such as to demand the utmost efficiency in achieving such transfer. Because of the inordinate weight associated with the loaded cargo containers, safety is of extreme importance in avoiding dislocation thereof which may cause damage to the cargo and, more importantly, personal injury to the dock workers.

Truck drivers are often paid on a flat rate per delivery basis thus providing considerable incentive for rapid unloading of cargo from trailers towed by their truck tractors. The containers are typically loaded on the truck trailers and locked thereto to prevent shifting of the containers relative to the trailer during transport to the dock site. A recognized problem is the fact that the truckers or other responsible personnel, from time to time, neglect to unlock such locking mechanism thus leaving the container locked to the truck as the crane hoisting mechanism raises the container. This oftentimes results in lifting of the truck itself and sometimes the attached truck tractor with the driver aboard. Then, when the locking mechanism fails, or otherwise releases, freeing the trailer from the container, the trailer and truck tractor may be dropped on to the underlying dock from a considerable height, such as 20 or more feet above the dock, often resulting in damage to the truck and trailer and injury to the driver. Consequently, there exists a need for a safety apparatus which will limit hoisting of such containers when locked to the trailer.

Detection systems have been proposed in transfer cranes for detecting and controlling the distance between multiple trolleys mounted on such crane. A device of this type is shown in U.S. Pat. No. 4,753,357 to Miyoshi. While satisfactory for their intended purpose, such devices fail to detect an unsafe condition in a cargo truck transporting cargo to the crane.

Other mechanisms have been proposed for detecting the attitude of a crane to indicate an unsafe condition. A device of this type is shown in U.S. Pat. No. 4,743,893 to Gentile et al.

Still further devices have been proposed for detecting potential collision between material handling devices and to protect against such collisions. A device of this type is shown in U.S. Pat. No. 2,814,032 to Agnew et al.

Crane safety cut off and overload devices have been proposed to enhance the safety of the operator and attendant personnel. Devices of this type are shown generally in U.S. Pat. Nos. 4,804,095 to Rohr et al., 4,003,482 to Cheze, 4,787,524 to Cobb et al. and 5,058,752 to Wacht et al., as well as U.S. Pat. No. 4,821,835 to Latvys et al. and 3,824,578 to Harders. However, none of these devices detect an unsafe condition in a cargo transport truck or respond to such a condition to render a loading crane inoperative.

In our co-pending patent application, now U.S. Pat. No. 5,260,688, the content of which is incorporated herein by reference, we disclosed the broad concept of a crane control system responsive to an unsafe condition in any one of a number of trucks serving such crane to render it inoperative. While that system has gained considerable acceptance, it has the shortcoming that under certain conditions the truck mounted sensors could be activated by a false signal such as in the instance when the sensing wand on the truck is accidentally or intentionally struck thus generating a false signal. In addition, the truck driver when delivering to a gantry crane must select the proper transmitter corresponding to the respective gantry crane which, if not properly selected, could disable the safety device.

SUMMARY OF THE INVENTION

The apparatus of the present invention is characterized by detectors on a cargo truck for detecting an unsafe condition and transmitting a signal to a hoisting crane for rendering such crane inoperative or otherwise correcting operation of such crane. In one aspect of the invention, respective trucks are equipped with redundant sensor modules operating in parallel such that either of said sensor modules can detect said unsafe condition and in turn cause the transmission of the respective signal to the hoisting crane rendering the crane inoperative.

It is a further object of the present invention to include lock out switches within the sensor modules to block transmission of the respective signal should the respective sensor respond to other than the unsafe condition.

It is an additional object of the present invention to transmit a predetermined signal ID which the hoisting crane must recognize before rendering the crane inoperative. Other objects and features of the invention will become apparent from consideration of the following description taken in conjunction with the accompanying drawing.

DESCRIPTION OF THE PREFERRED EMBODIMENT

Figure 1:
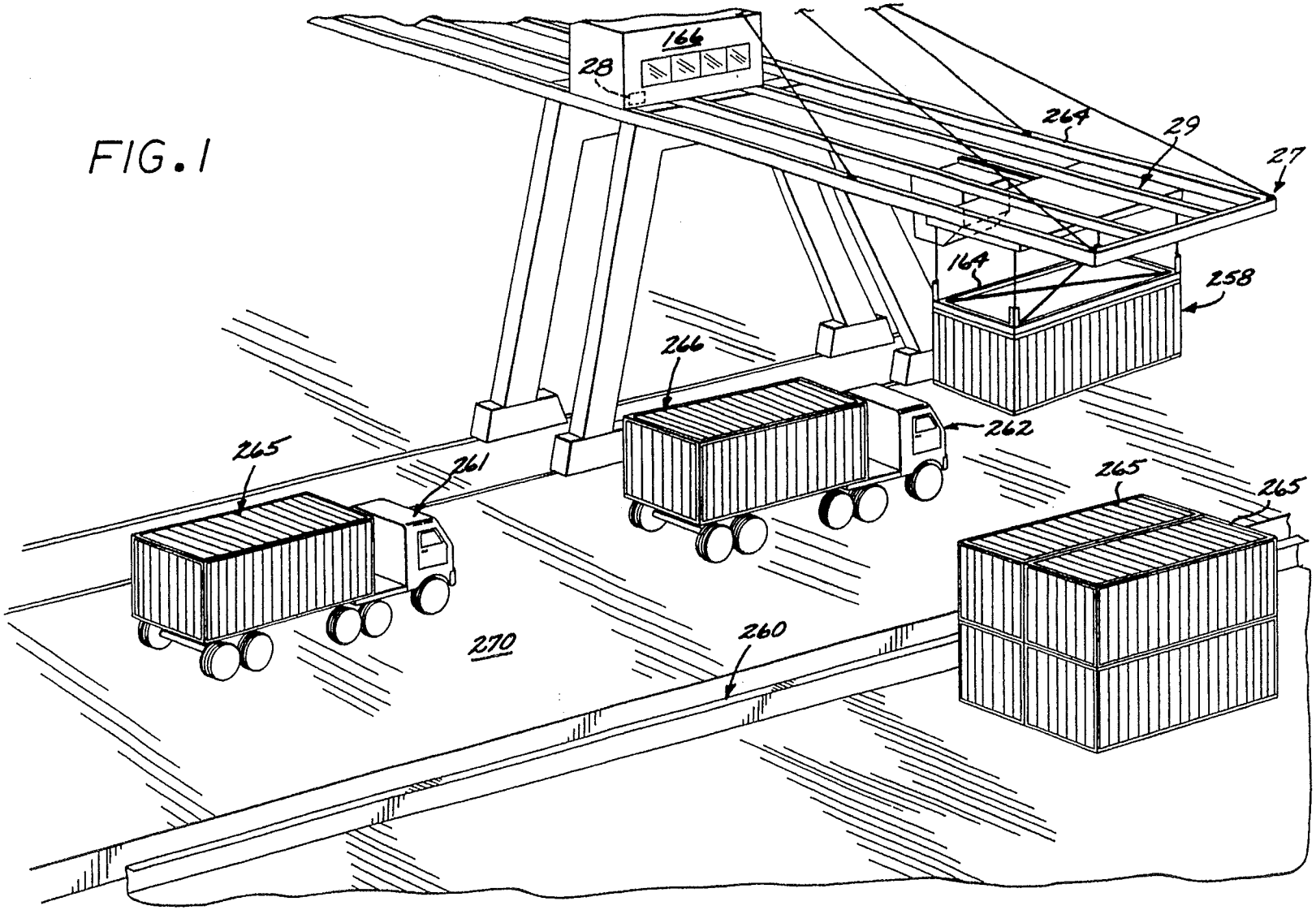
FIG. 1 is a perspective view of a cargo safety apparatus embodying the present invention.

The crane safety apparatus of the present invention includes, generally, a detector wand 11 (FIGS. 2 and 3) which may be suspended from the front bumper of a truck tractor by means of a switch box 12. Such switch box is electrically coupled to the first 18 of a pair of sensor modules 18 and 19 comprising part of a transmitter logic circuit, generally designated 17 (FIG. 7), housed with a transmitter housing mounted in the truck cab 13 for convenient viewing by the driver. The first of the sensor modules 18 electrically connects the switch box with a lock-out mercury switch 22 and connects in parallel with the second sensor module 19 that includes a mercury switch which acts as a back up inclinometer safety switch 24. The sensor modules 18 and 19 are electrically connected to a transmitter 26 that is actuated by either of the sensor modules individually to transmit a safety signal to a switch controller 28 (FIG. 5) in response to detection of an unsafe condition such as that shown in FIG. 3. The controller 28 is connected in circuit with the control circuit 30 (FIG. 8) controlling power to the gantry crane, generally designated 27 (FIG. 1). Such switch controller 28 is then operative to deactuate such control circuit and consequently the lifting mechanism, generally designated 29 (FIG. 1), to discontinue lifting of the cargo container, generally designated 31 (FIG. 3), carried on the truck trailer 33.

Figure 6:
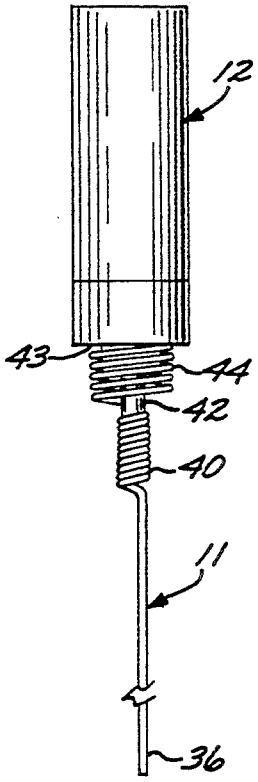
FIG. 6 is a perspective view, in enlarged scale, of a feeler wand and switch box included in the apparatus shown in FIG. 3.

The switch box 12 mounts a universal micro-switch having a downwardly projecting actuating stem 42 projecting downwardly through an oversized bore in a boss 43 formed on the underside of such box. The box itself is rectangular in shape and configured to be mounted to the front bumper of a truck tractor (FIG. 2) in an upright orientation. The detector wand 11 (FIG. 6) is in the form of a base formed by a small diameter gripper coil portion 40 coaxially received in close fitting relation over the bottom end of the switch control stem 42 and an enlarged dampening spring coil 44 formed to be received in loose fitting relationship over the boss 43 to thereby cooperate in resiliently resisting manipulation of the switch actuating stem to prevent undue oscillation. A ¼ diameter feeler rod 36 about 12 inches long and constructed of acetyl plastic sold under the commercial designation DELRIN is screwed on its upper end into the open end of the gripper spring 40 to project downwardly from behind the front bumper of the truck tractor.

Figure 4:
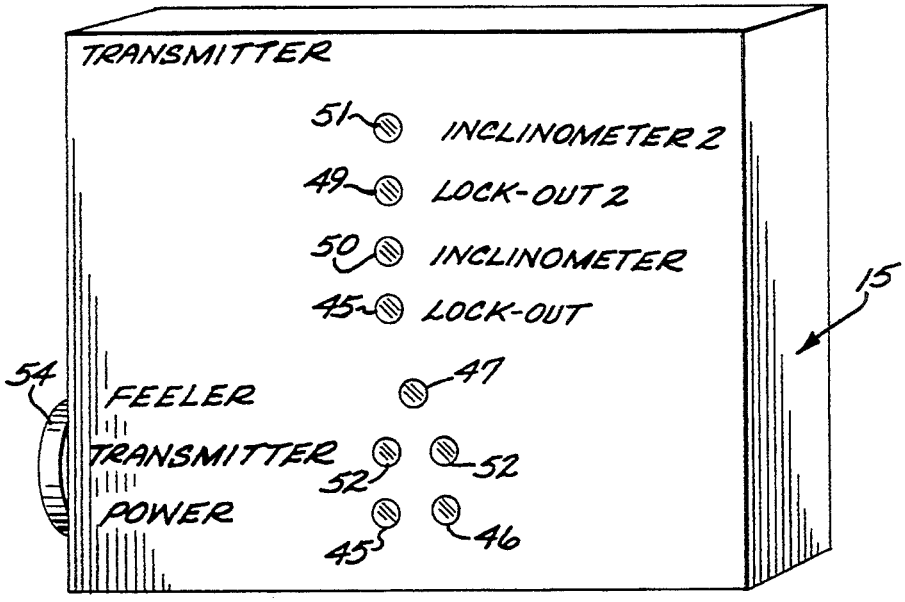
FIG. 4 is a perspective view, in enlarged scale, of a transmitter included in the apparatus shown in FIG. 3.

The transmitter housing 15 (FIG. 4) is preferably in the form of a self-contained, sealed box to prevent moisture from entering the housing. Light emitting diodes (LEDs) mounted on the front of the box are connected in circuit to act as power indicators 45 and 46, feeler indicator 47 and transmitter indicators 52.

Pairs of LED light indicators 48 and 50 and 49 and 51 are then provided so that the pair hard wired to the active circuit components will signal activation. A first lock out indicator 48 and first inclinometer indicator 50 are connected with a first pair of switches as described below and a second lock out indicator 44 and second inclinometer actuation indicator 51 are connected with a second set of switches to provide visual indication to the truck driver as to the operation of the transmitter logic circuit 17. A sealed grommet 54 provides for convenient electrical connection of the transmitter logic circuit to the vehicle battery and outside sensors such as the switch box 12.

Figure 7:
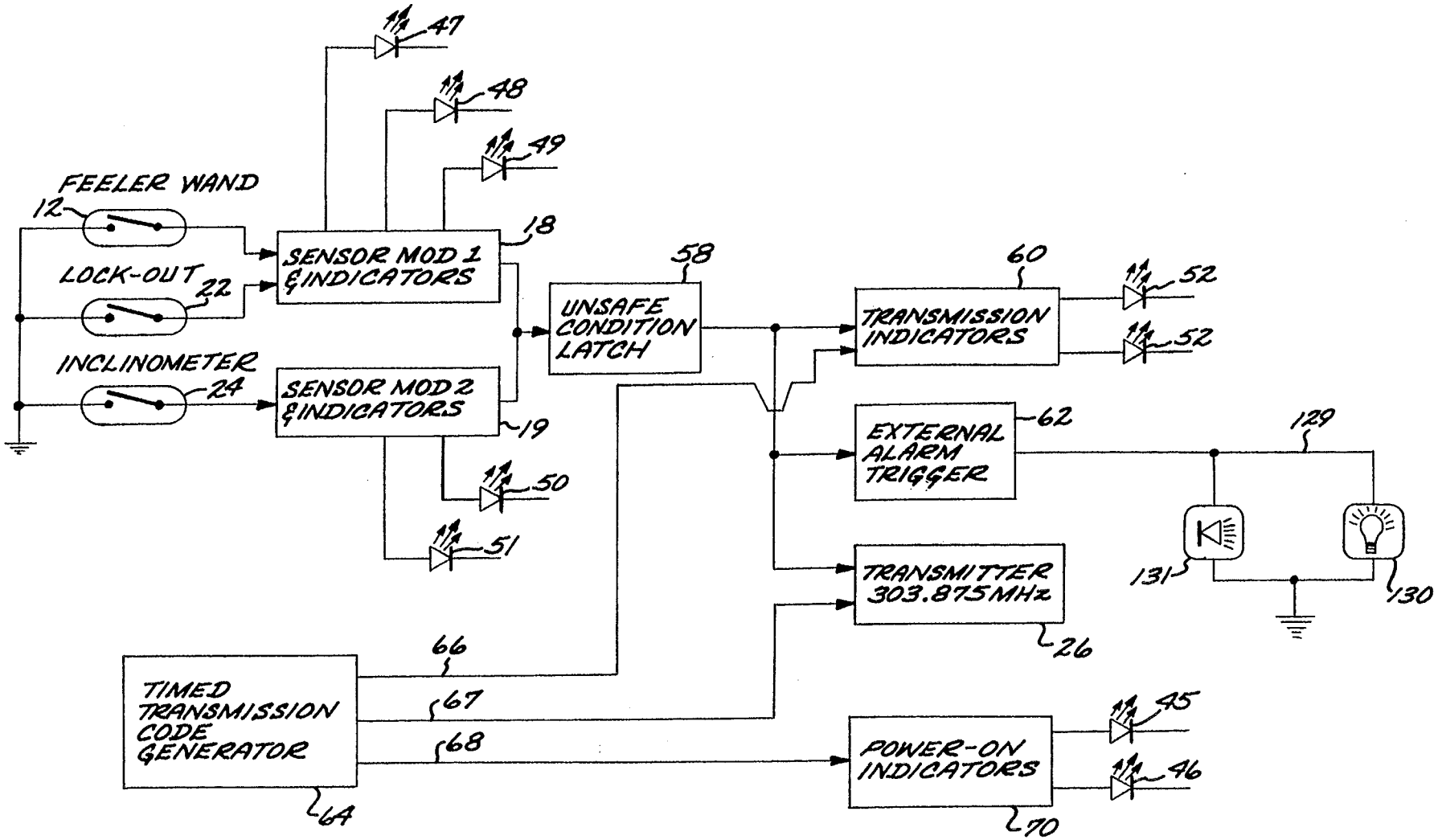
FIG. 7 is a functional block diagram of a transmitter logic circuit incorporated in the safety apparatus shown in FIG. 1.
Figure 8:
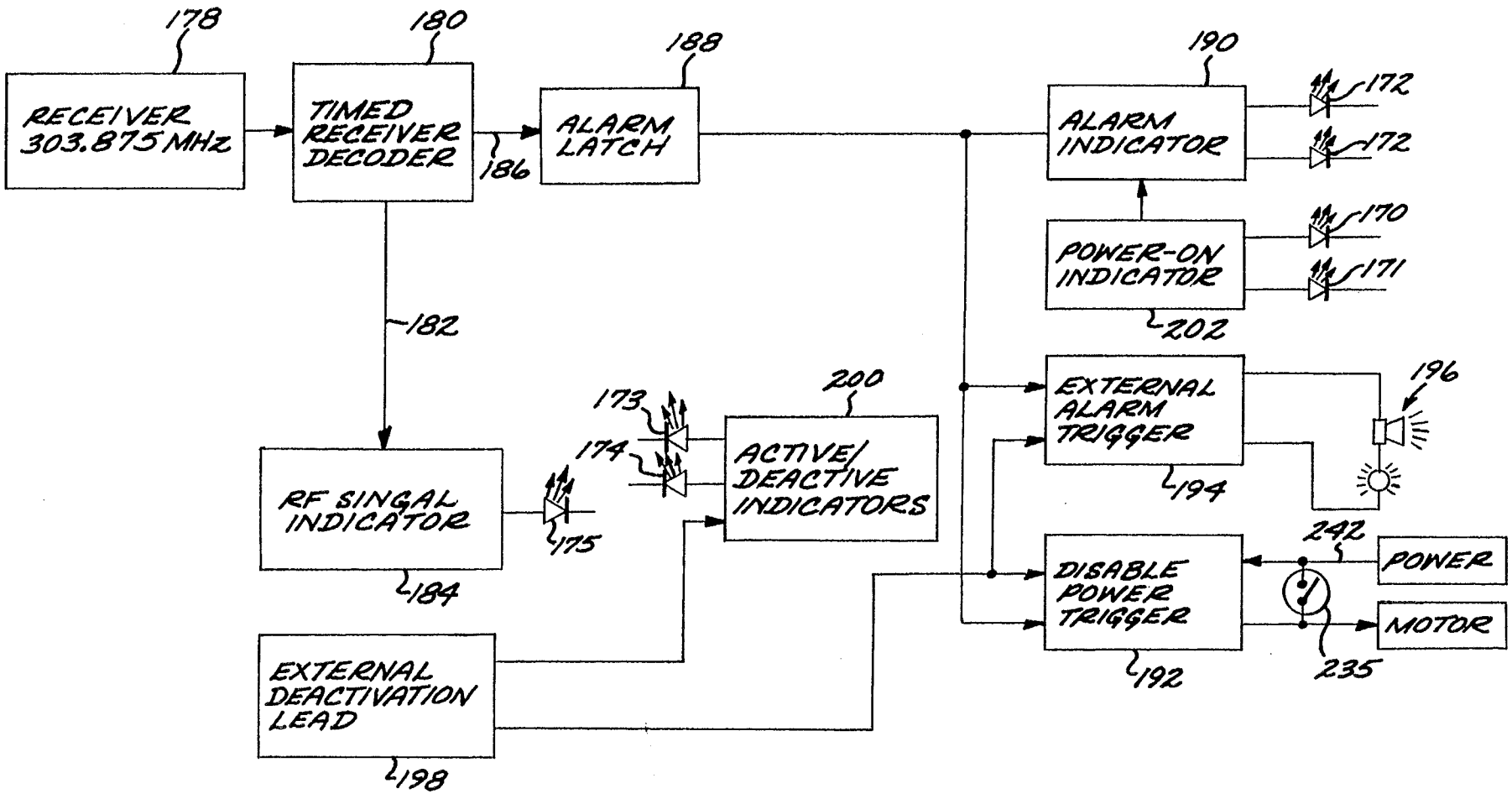
FIG. 8 is a functional block diagram of the gantry crane deactuating circuit incorporated in the invention shown in FIG. 1.
Figure 9:
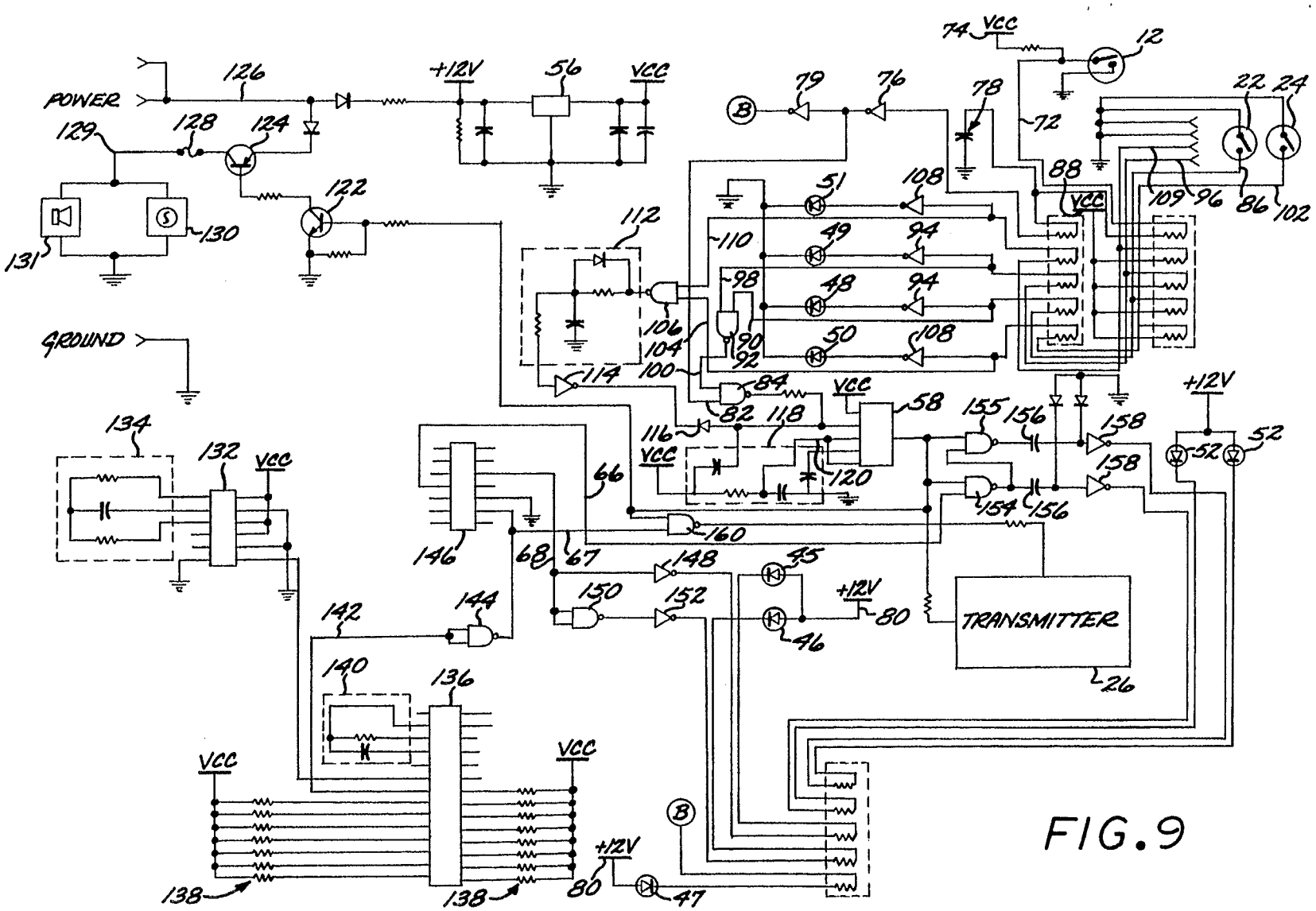
FIG. 9 is a schematic of the transmitter logic circuit incorporated in the safety apparatus shown in FIG. 1.

The individual transmitter circuits shown in FIGS. 7 and 9 are powered from the 12 volt battery in the vehicle through a connection leading to a 12 to 5 volt balanced voltage regulator 56 (FIG. 9). Functionally, the transmitter circuit 17 (FIG. 7) includes two sensor modules 18 and 19 for determining the unsafe condition in the truck with the first 18 of the two sensor modules connecting to the switch box 12. The second sensor module 19 functions as a safety override which triggers the safety signal in the event the first sensor module 18 fails. The output of the sensor modules connect in parallel to the input of an unsafe condition latch 58. The latch output connects in parallel to a transmission signal indicator circuit 60, an external alarm trigger 62, and the transmitter 26. A timed transmission code generator 64 includes three output leads 66–68 to independently connect to the transmission signal indicator 60, the transmitter 26, and a power-on indicator circuit 70, respectively.

Although principally housed in the transmitter housing 15, the first sensor module 18 (FIG. 9) includes a switch box lead 72 which connects to ground through the switch box 12 located on the front bumper 38 of the truck. The switch box lead connects between an impeded load 74 and the input of an buffer/invertor 76 through a resistor-capacitor (RC)delay circuit 78. The output of the switch box buffer/invertor 76 connects in parallel through a buffer/invertor 79 and a reverse biased feeler switch LED 47 mounted on the front of the transmitter housing 15 to an LED load 80 and to the first input 82 of a first sensor module NAND gate 84. The first mercury switch 22 is mounted on the circuit in a position inclined in one direction to the horizontal to lock the circuit out until tilted more than 2° to the horizontal to connect one terminal of the first sensor module between ground and a first mercury lead 86. The first mercury lead 86 connects between an impeded voltage load 88 and the impeded first input 90 of a second logical NAND gate 92. Connected in parallel with the first input of the second NAND gate, an impeded buffer/invertor 94 connects across a forward biased 2° mercury switch LED 48 mounted on the front of the transmitter housing 15 to ground. A second mercury input lead 96 connects to one end of a second lock out mercury switch (not shown) inclined symmetrically in a direction opposite to the first switch to close a circuit when tilted more than 2° connected on its opposite end to the second input 98 of the second NAND gate 92 similar to the first mercury switch 22 and is mounted opposite the first mercury switch 22. The output of the second NAND gate 92 connects to the second input 100 of the first NAND gate 84 with the first NAND gate output then connecting to the unsafe condition latch 58.

The second sensor module 19 includes the mercury switch 24 inclined in one direction to the horizontal to close a circuit when tilted 22° to the horizontal to connect between ground and a third mercury switch lead 102. The third lead connects between the impeded voltage load 88 and an impeded first input 104 of a third logical NAND gate 106. Connected in parallel to the first input 104, an impeded buffer/invertor 108 connects across a forward biased LED 50, mounted on the front of the transmitter housing 15, to ground. A fourth input lead 109 for attaching a forth mercury switch (not shown), inclined to close a circuit when tilted 22° in a direction opposite that for the switch 24 and connected in circuit between the impeded load 88 and the second input 110 of the third NAND gate 106 and LED 51 to serve as a redundant safety switch. The output of the third NAND gate 106 connects to an RC delay circuit 112 which functions as a delay lock out. The output of the timing circuit 112 connects through an buffer/invertor 114 and reverse biased diode 116 to connect with first sensor module output to the input of the safety signal latch 58 to thus trigger the safety signal latch upon tilting of the truck more than 20° for a time period exceeding three seconds, in the preferred embodiment.

As thus described, so that the transmitter box may be mounted facing laterally in either direction, the duplicate mercury switches (not shown) are included but angled symmetrically in opposite inclinations so that the non-operative set may be selectively shunted out of the circuit when the housing is mounted in a position where the opposite set are to be operative.

In the exemplary embodiment, the safety signal latch 58 consists of a two-state integrated circuit of the type LM555CN manufactured by National Semiconductor. A latch hold consisting of an RC timing circuit 118 connects to a signal hold input lead 120 on the latch.

The alarm trigger 62 (FIG. 7) includes a transistor 122 (FIG. 9) that has an impeded base connected to the output lead from the safety signal latch 58. The transistor 122 connects at its emitter to the base of a high amperage transistor 124. The high amperage transistor 124 connects between the forward biased power leads 126 at the collector and a thermal fuse 128 at the emitter that connects in series to an external alarm output 129. The alarm output 129 can connect to any external visual 130 or audio 131 devices included in the vehicle such as the headlights or horn.

Operating independently from the safety latch 58, the transmission code generator 64 (FIG. 7) includes a digital clock pulse generator 132 (FIG. 9) consisting of a CD4541BE integrated circuit manufactured by Harris Semiconductor in the exemplary embodiment connected with an RC timing circuit 134 which cycles at approximately 13 KHz. The clock pulse generator 132 connects with a signal encoder 136 similar code devices used in garage door openers. In the exemplary embodiment, the encoder 136 consists of an ED15P integrated circuit manufactured by Supertex, Santa Clara, Calif. Impeded loads 138 selectively are connected across pins 8–22 of the ED15P to form a 15 bit digital code to thus function as a signal identifier. An RC timing circuit 140 connects at pins 2–4 to provide bit output timing for the coded signal. The coded signal output lead 142 is buffered and inverted through both inputs of a NAND gate 144 functioning as a buffer/invertor to the transmitter 26 through the second output 67 of the timed transmission or code generator 64 (FIG. 7) and in parallel to a digital divider 146 (FIG. 9) consisting of a MC14020BCP integrated circuit manufactured by Motorola in the exemplary embodiment. The output leads one 66 and three 68 of the generator 64 (FIG. 7) connect to the transmission indicator 60 and the power indicator circuits 70, respectively.

The power indicator circuit input lead 68 connects in parallel to an buffer/invertor 148 across a first reverse biased power LED 45 mounted on the front of the control box to the LED common load 80 and to both inputs of a NAND gate 150 functioning as a buffer/invertor through an buffer/invertor 152 to a second reverse biased power LED 46 mounted proximate the first LED 45 on the front of the transmitter housing 15 to the LED common load 80.

The transmission indicator circuit 60 includes two input leads that connect to the unsafe condition latch 58 and the code generator output lead one 66, respectively. A pair of NAND gates 154 and 155 connect to the latch lead at their respective first inputs. The second input of the first of the NAND gates 154 connects with the code generator output lead 66. The other NAND gate 155 second input connects to the output of the first NAND gate 154 to function as a flip/flop. The outputs of both NAND gates connect to respective transmission LEDs 52 mounted on the front of the transmitter housing 15 through respective capacitors 156 and respective buffered/invertors 158 to the common LED load 80 to thereby provide alternating illumination of LEDs 52.

Figure 2:
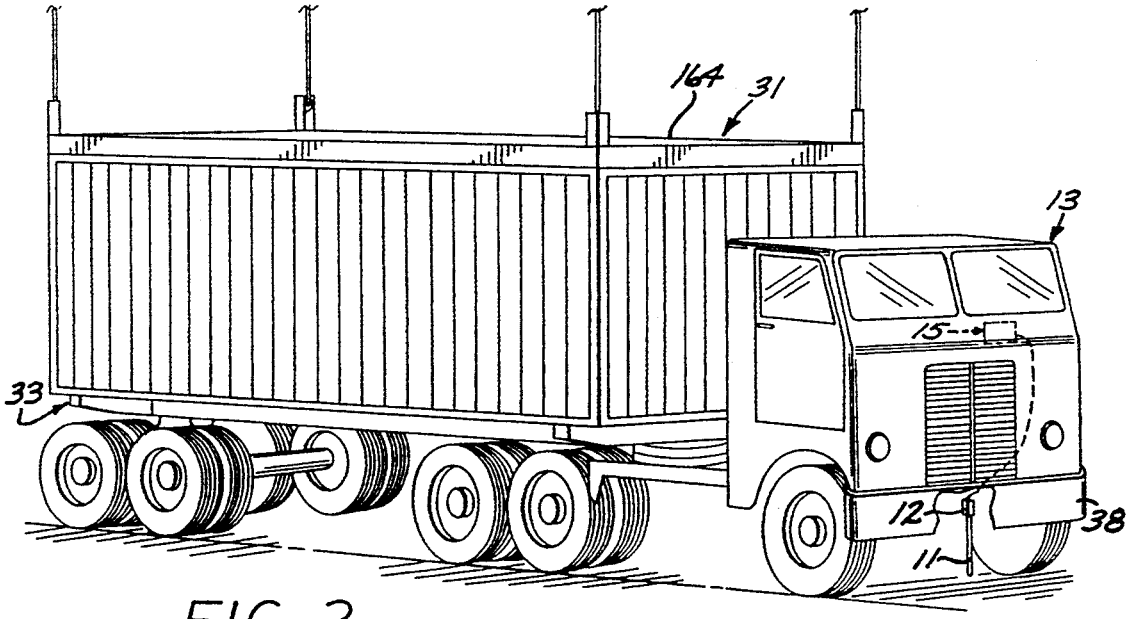
FIG. 2 is a perspective view, in enlarged scale, of a truck trailer shown in FIG. 1 being prepared for off loading of a container.

The transmitter receives input leads connected from the code generator output lead two 67 and the unsafe condition latch 58 to the respective inputs of a NAND gate 160. The NAND gate output connects to a transmitter device 26. In practice, the transmitter and associated receiver may take many different forms. For instance, the transmitters may be in the form of infrared lamps mounted on tops of the respective cabs and operative to transmit a beam to an optical sensor mounted on, for instance, the front rail of the spreader 164 (FIG. 2).

In the exemplary embodiment, the transmitter device is of the type typically utilized as a remote actuator for an automobile alarm system of the type sold under the trade designation POP-A-LOCK by Design Tech Int'l, Inc., 7401 Fullerton Road, Springfield, Va. 22153.

Located on the gantry crane 27, the switch controller 28 is housed in a sealed box 168 mounted within the operator cab 166 (FIG. 1) of the gantry crane. The box 168 (FIG. 5) is sealed to keep out moisture from the components housed inside. The front of the box includes a plurality of indicator LEDs 170–175 mounted on the surface of the box which visually indicate to the operator switch controller status as to power 170 and 171, alarms 172, activation/deactivation conditions 173 and 174, and radio interference 175. The side of the box includes a sealed grommet 176 which allows the controller 28 to connect to the crane's power supply as well as other components such as external alarms.

Figure 10:
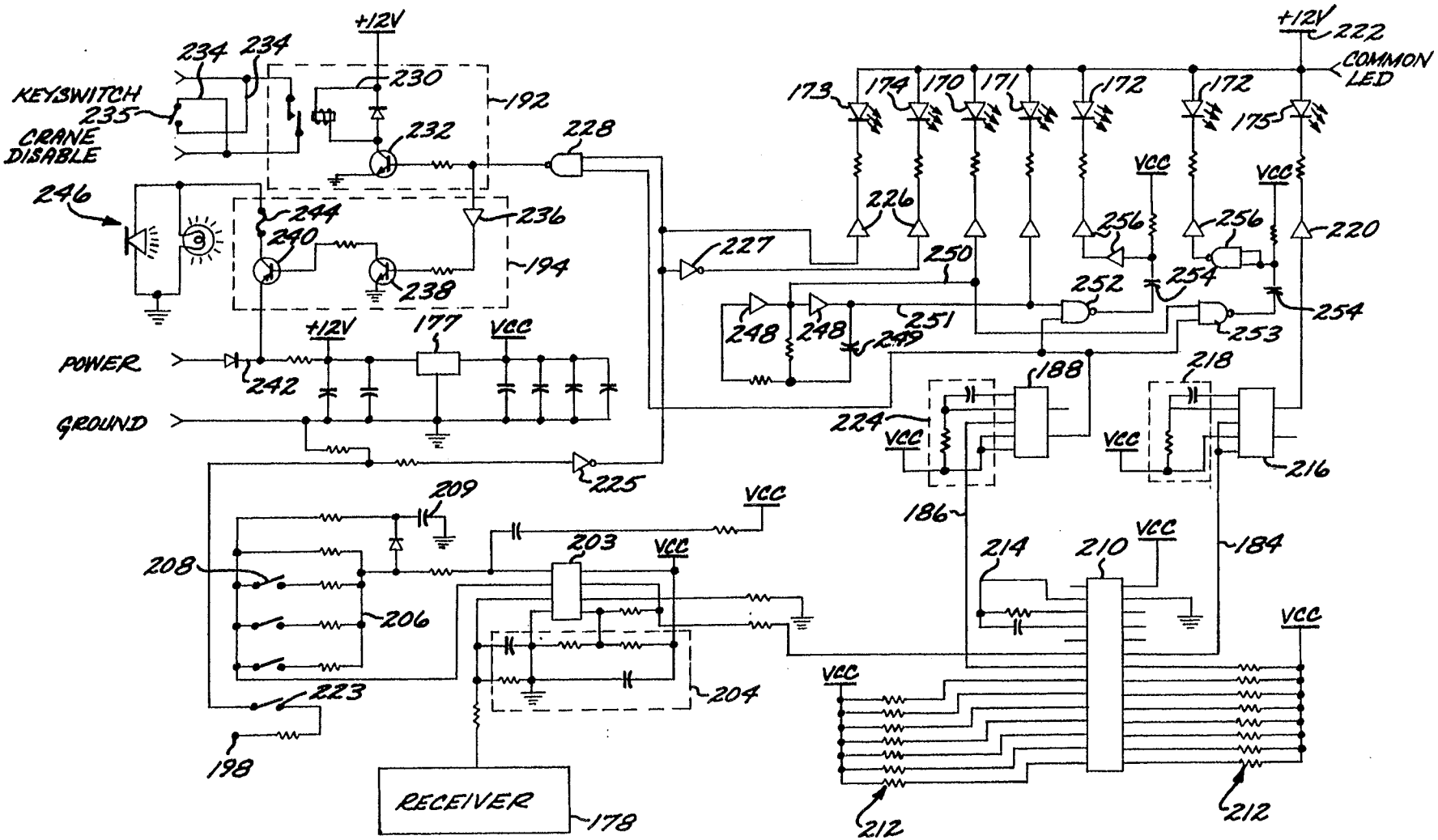
FIG. 10 is a schematic of the gantry crane deactuating circuit incorporated in the invention shown in FIG. 1.

Housed within the controller box 168, the switch controller 28 (FIGS. 8 and 10) connects with the 24 volt gantry power supply through a balanced 24 to 5 volt voltage regulator 177. Functionally the switch controller circuit 30 (FIG. 8) includes a receiver 178 for receiving the operation signal transmitted from the transmitter logic circuit 17. The output of the receiver 178 connects with a receiver decoder 180 which includes two outputs 182 and 186. A sensed signal output lead 182 from the receiver decoder 180 connects with a RF signal indicator 184 to indicate signals are being transmitted to the receiver which functions as an RF interference alarm. A verified operation signal output lead 186 from the receiver decoder connects with an alarm latch 188. The alarm latch output connects with an alarm indicator 190, a power disable trigger 192 and an external alarm trigger 194. An output lead from the external alarm trigger connects to an alarm 196 within the operator's cab 166. The power disable trigger 192 connects in circuit between the hoisting mechanism 29 and the power source to function as an interrupt switch. An independent deactivation lead 198 connects rotary switches 199 located on the gantry crane 27 to the alarm trigger 194, power trigger 192, and activation/deactivation indicators 200. These rotary switches respond to crane isolation sensors (not shown) which indicate the vertical and horizontal location of the hoisting mechanism 29, and transmit a safety arming signal to activate the control circuit only when the hoisting mechanism is in a position to hoist cargo from the respective trucks. Finally, a separately operated power indicator circuit 202 also connects with the internal alarm and power LEDs.

Although many different forms of receivers may be used to complement the transmitter, in the exemplary embodiment, the receiver 178 is of the type typically utilized as a receiver for an automobile alarm system of the type sold under the trade designation POP-A-LOCK by Design Tech Int'l, Inc., 7401 Fullerton Road, Springfield, Va. 22153.

The output from the receiver 178 (FIG. 8) connects to a latch 203 integrated circuit such as a LM258 manufactured by Texas Instruments in the exemplary embodiment and includes frequency filters 204 in the form of impeded capacitors to filter any noise from the receiver output. A bridge of resistors 206 connected in parallel with DIP switches 208 connect with a capacitor 209 to function as an adjustable RC timing delay circuit for verification of the transmission and connect to the trigger of the latch 203. The output of the latch connects with a decoder integrated circuit 210 using an ED15P integrated circuit as used in the transmitter logic circuit in the exemplary embodiment. Only here the ED15P 210 is configured to sense the encoded operation signal and generate a verification signal in response to sensing the operation signal to thus function as a signal recognizer. Impeded loads 212 are selectively applied to pins 8–22 in the same configuration as the encoders 136 (FIG. 9) impeded loads such that the decoder 210 may recognize the encoded 15 bit signal. An RC timing circuit 214 connects to pins 2–4 to provide internal bit timing to the decoder and a signal detection output lead 182 connects to the signal indicator 184. An operation signal received output lead 186 extends out of the ED15P and connects with the alarm latch 188.

The signal received indicator 184 consists of a delay response latch 216 of the type MC14538BCP manufactured by Motorola with timing controlled by an RC timing circuit 218 set for a one second delay. The indicator connects through a buffer/invertor 220 to a reverse biased RF signal LED 175 mounted on the controller box to an LED common load 222.

The alarm latch 188 includes a delay response latch similar to latch 216 above with timing controlled by an RC timing circuit 224 set for a 10 second delay in the preferred embodiment.

The external deactivation lead 198 connects through a factory preset off switch 223 and buffer/invertor 225 to a pair of reverse biased LEDs 173–174 connected to the LED common load 222 through respective buffer/invertors 226. One of the LED leads 174 includes a second buffer/invertor 227 connected in series with the first to provide alternating illumination between the two LEDs 173 and 174.

The power disable trigger 192 and external alarm trigger 194 (FIG. 8) are both actuated from the same output leads from the alarm latch 188 and external deactivation lead 198 that connect to separate inputs of a NAND gate 228. The output of the NAND gate 228 connects in parallel to the external alarm trigger 192 and power disable trigger 194.

The power disable trigger 192 includes a power relay switch 230 connected between the crane hoisting motors and power supply. A relay switch of the type manufactured by Stancor model number TS-9024 is suitable for this purpose. The relay 230 connects to the collector of a transistor 232 with the emitter connected to ground. The NAND gate 228 connects to the base of the transistor 232 which functions as a trigger for the relay 230. Leads 234 connecting to a key operated override switch 235 connect in parallel with the relay switch output leads. The override switch 235 when activated bypasses the relay switch to re-energize the hoisting mechanism.

The alarm trigger 194 includes a buffer/invertor 236 which connects to the output lead from the NAND gate 228. The buffer/invertor 236 connects to the base of a transistor 238 connected to ground at the emitter and to the impeded base of a high amperage transistor 240 of the type TIP147 manufactured by Texas Instruments at the collector to trigger the high amperage transistor which connects between the power source lead 242 at the collector and a thermal fuse 244 at the emitter. The fuse 244 connects in series with the alarm output lead to the external alarm 246. Any preexisting audio or visual warning devices within the operator's cab maybe wired to the external alarm lead.

The power indicator circuit 202 (FIG. 8) includes a pair of buffer/invertors 248 (FIG. 10) connected in series and bridged by an impeded capacitor 249 to alternate the output of the buffer/invertors. Two separate leads 250 and 251 extend from the output of the respective buffer/invertors and connect in parallel to respective reverse biased power LEDs 170 and 171, mounted on the controller box, through respective buffer/invertors to the LED common load 222 and to second inputs of respective NAND gates 252 and 253 included in the alarm indicators 190. With the first inputs of the respective NAND gates 252 and 253 connected to the alarm latch 188, the output of the respective NAND gates connects through respective capacitors 254 with an impeded load to the input of a respective pair of buffer/invertors 256 connected in series. The respective pair of buffer/invertors connect to the LED common lead 222 through respective reverse biased alarm LEDs 172.

In the loading of cargo onto ocean going ships, the individual units of cargo are typically loaded into large containers 258, frequently at an inland site and such containers are then transported to the dock area and either temporarily stored or loaded directly onto the ship, generally designated 260, by means of a gantry, or hammerhead, crane 27. Due to the significant expense of lay days while a ship is in dock, it is important that such loading be achieved in a relatively rapid manner.

Figure 3:
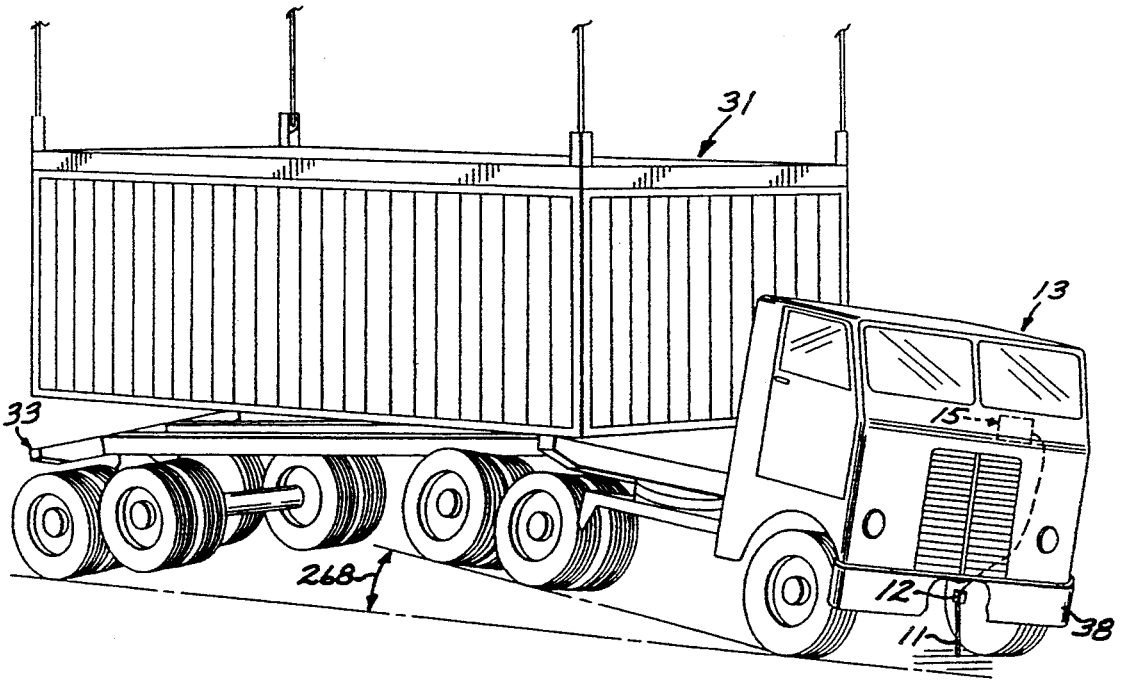
FIG. 3 is a perspective view, similar to FIG. 1, but showing a corner of the trailer being hoisted with the container.

Typically, the containers incorporate hold down mechanisms at the four bottom corners which are manually actuated to lock the container onto the trailer 33 to prevent shifting during transport over the roadway. When the trailer reaches the unloading location on the dock, it is the responsibility of the truck driver or other personnel to manually unlock such container locking mechanisms to disengage them from the trailer itself. From time to time, in the rush for rapid off-loading of the trailer, the unlatching procedure may be neglected or the latching mechanism itself may become hung up in the trailer, thus preventing full unlatching thereof. For the purpose of demonstration herein, a situation is depicted in FIG. 3 where the latching mechanism of the front right corner of the container 31 is shown as remaining latched to the trailer 33 during hoisting of the trailer by means of the crane 27. It will be appreciated that, in practice, all four corner locks may be inadvertently left locked resulting in the entire trailer being hoisted off the dock.

In at least some instances, the locks have remained engaged to the point where the lifting mechanism 29 (FIG. 1) has raised the trailer 33 to the elevation where it and the attached tractor 13, are lifted to a substantial elevation above the deck of the dock. Then when the mechanical lock, or locks, unlock or fail under the weight of the hoisted truck and trailer, the trailer is freed to drop to the deck of the dock. The resulting high impact contact can cause great damage to the equipment and result in injury to any truck driver remaining in the cab of the tractor 13.

In many instances, a number of cranes 27 are spaced along a dock 41 for loading into one or more holds of a ship being serviced by a number of transport trucks, such as the truck 13, accompanied by additional trucks, generally designated 261 and 262 (FIG. 1). The cranes 27 typically incorporate an overhang formed by a plurality of parallel tracks 264 from which is suspended a trolley carrying the hoisting mechanism 29. Suspended therefrom is a spreader 164 for locking onto the top of the various containers 265 and 266 to hoist them from the trucks 261 and 262 to be suspended from such trolley. The trolley then carries the hoisting mechanism 29 along the rails 264 to a location over the ship 260 to deposit the individual containers 265 on the deck or in the ship's hold as the case may be.

Figure 5:
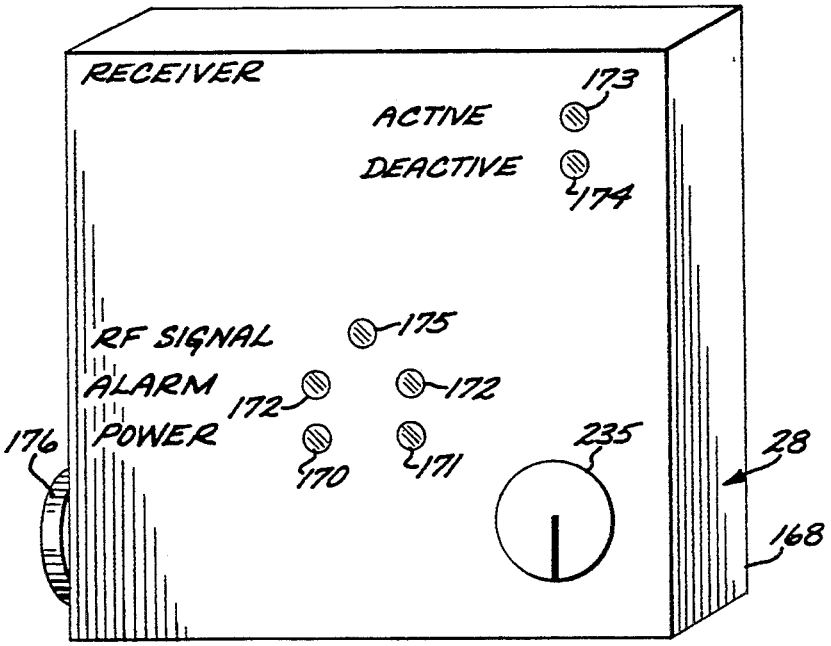
FIG. 5 is a perspective view, in enlarged scale, of a control box included in the apparatus shown in FIG. 3.

It will be appreciated by those skilled in the art that the detector switch 12 may be conveniently mounted, for instance, behind the front bumper of the truck tractor 13. The feeler wand 11 may be adjusted to the desired height to set the angle 268 (FIG. 3) to which the rear of the tractor 13 must be inclined to cause closure of the detector switch 12 (FIG. 5). In the preferred embodiment, the angle is established to limit hoisting of the rear wheels of the trailer to about 12 inches above the dock.

The feeler wand 11 and detector switch housing 12 are mounted on the truck bumper 38 and arranged to cooperate in completing a circuit within the first sensor module 18 only when the tractor is tilted to or above the angle shown in FIG. 3. Depending on the orientation of the housing 12 as mounted, the lock out and inclinometer switches, not oriented for use, are shunted out of the circuit. The mercury switch 22 also closes when the tractor is tilted and functions as a lock-out switch to ensure against false triggering of the detector switch 12.

Should the wand 11 at any time while the truck 13 is in its normal level position on the deck be deflected, as by being bumped or kicked without inclination of the truck, the mercury switch 22 will remain open to prevent unwanted activation of the transmitter should the wand fail to respond to tilting of the truck.

In the event that the first sensor module 18 does not trigger the safety signal, the second sensor module 19 is operative to trigger the safety signal when the truck has been titled at the angle shown in FIG. 3 for a predetermined period of time using the mercury switch 24 functioning as an inclinometer.

It will also be appreciated by those skilled in the art that the detector 12 itself may be of any convenient form which will be responsive to inclination of the tractor or elevation of the rear wheels thereof or even the elevation of the trailer or some portion thereof.

In operation, a feeler wand and transmitter housing will be mounted on each of the trucks 13,261 and 263 to be utilized in transporting cargo containers to the hoisting mechanisms of the various cranes being utilized to load the ship 260 or associated ships moored at the dock 270. The controller 28 will be installed in the operator's cab 166 as shown in FIG. 1 and will be connected in series with the hoisting motor of such mechanism.

When a truck 13, 261 or 263 is then servicing a particular crane, as for instance the crane 27, the receiver is factory tuned to the same frequency and set to receive the same operation code signal as the transmitter 26. Should the unfortunate event occur that the driver or attending personnel fail to unlatch the container latching mechanism associated with the trailer 33 and the hoisting mechanism 29 be actuated to lift, for instance, the container 31 shown in FIG. 3, thus raising the trailer, the rear of the tractor 13 will be elevated as shown. Such elevation of the rear of the tractor will lower the front bumper to such a degree as to first cause the mercury switch 22 to close and then cause the feeler wand 11 to engage the surface of the dock 270. Engagement of such wand and elevation of the rear of the trailer will cause such wand to close the detector switch 12 (FIG. 5) thereby energizing the safety latch 58 and the respective indicator lights 47 and 48. The safety latch 58 is then operative to energize the transmitter 26 and the transmitter indicator lights 52 to thereby emit an operation signal having the 15 bit signal ID code from the timed code generator 64 through the transmitter 26 to the controller 25.

The receiver 178 (FIG. 5) and decoder 180 within the controller 25 associated with the crane 27 hoisting the container 31, which recognizes the operation signal having the 15 bit signal ID code, will then respond to energize the alarm latch 188 and illuminate the RF indicator 175 and alarm indicators 172. The alarm latch 188 will in turn open the alarm trigger 194 to energize the external alarms 196 and the power trigger 192 to thereby switch off the relay 230 de-energizing the hoisting motor in the hoisting mechanism 29. This then serves to stop the lifting action on the truck at a point where it remains safe for the truck and driver.

Once power is shut-down, the crane operator may then insert a key in the override switch 235 and close that switch to re-energize the hoisting mechanism to thus provide power to enable him to reverse the hoisting motor to lower the container 31 and, consequently, the tractor 13 thereby avoiding damage to the machine and injury to the truck driver.

The attendant personnel may then check the container locking mechanism to be assured that it is released for disengagement from the trailer. The hoisting mechanism may be then actuated to hoist the container 31 clear of the trailer 33.

Should the receiver 178 receive signals that do not match the 15 bit code for the operation signal, the RF or signal indicator 175 will illuminate to warn of possible radio interference. To overcome problems with possible interference and provide redundancy, two of the controller boxes 168 may be installed on opposite sides of the operator's cab 166 and may be connected in parallel.

The transmitter 26 will only affect those cranes 27 positioned to hoist cargo from a truck 13. The external activation lead 198 receives signals from relay switches located on the crane's spreader 164 and hoisting mechanism 29 to deactivate the controller 25 when the crane 27 is not positioned to hoist cargo from a truck. Thus only a properly positioned crane will be shut down by the operation signal. Activation and deactivation indicators 173 and 174 on the controller box 168 indicate whether the crane spreader 164 is positioned to cause the controller to respond to the operation signal.

From the foregoing, it will be appreciated that the safety apparatus of the present invention provides a convenient, economical and reliable apparatus for assuring safe off loading of containers from the trailers without subjecting the tractor or driver to damage or injury from inadvertent elevation of such tractor above the surface of the dock.

Various modifications and changes may be made with regard to the foregoing detailed description without departing from the spirit of the invention.

What is claimed is:

1. Transmitter apparatus for mounting on a cargo transport to sense an unsafe condition and responsive thereto to generate an operational signal and comprising;

a housing for mounting on said cargo transport in a predetermined orientation;

a condition sensor responsive to a predetermined unsafe condition to generate a safety signal;

a transmitter responsive to said safety signal to generate an operational signal; and lock out means including lock out switch means for normally locking said condition sensor out to render it ineffective to communicate said safety signal to said transmitter and including a threshold sensor for sensing a threshold condition less than said unsafe condition, and responsive to said threshold condition to operate said lock out switch means to form a circuit path for said safety signal to said transmitter.

2. Transmitter apparatus according to claim 1 that includes:

a safety override sensor connected in parallel with said condition sensor and responsive to a second predetermined unsafe condition to generate a said override safety signal, said safety override sensor being connected with said transmitter; and a time delay responsive to said override safety signal to, for a predetermined period of time, block said safety signal from communication to said transmitter.

3. Transmitter apparatus according to claim 1 that includes:

a safety override sensor connected in parallel with said condition sensor and responsive to a second predetermined unsafe condition to generate a said override safety signal, said safety override sensor being connected with said transmitter.

4. The transmitter apparatus according to claim 1 that includes:

an alarm trigger connected in circuit with said condition sensor and responsive to said safety signal to generate an alarm signal; and an alarm for mounting in said cargo transport and connected in circuit with said alarm trigger, said alarm trigger being operative in response to said alarm signal.

5. Transmitter apparatus according to claim 3 wherein:

said safety override sensor includes an inclinometer.

6. Transmitter apparatus according to claim 1 that includes:

a signal identifier connected in circuit with said transmitter and operative to impose an identification characteristic on said operation signal.

7. Transmitter apparatus according to claim 1 wherein:

said condition sensor is in the form of a resilient feeler wand including a support spring in contact with said housing to support said feeler wand against undue oscillation.

8. Transmitter apparatus according to claim 7 wherein:

said housing is formed with a bore;

said condition sensor includes a universal switch including an actuation stem projecting through said bore and orbital in different directions to actuate said universal switch to generate said safety signal; and said feeler wand is constructed of spring steel, is formed intermediately with a coil mounting spring gripping said stem and said dampening spring is defined by a coil spring formed integral with said wand and interposed between said gripping coil and said housing to partially compress when said stem is flexed to one side or the other to thus resiliently resist orbiting of said stem.

9. Transmitter apparatus according to claim 1 wherein:

said condition sensor is responsive to inclination of said cargo transport to a predetermined angle to generate said safety signal.

10. Transmitter apparatus according to claim 9 wherein:

said threshold sensor is in the form of an inclinometer responsive to a threshold inclination of said cargo transport less than said predetermined angle to operate said lock out switch.

11. Transmitter apparatus according to claim 10 that includes:

a safety override sensor connected in parallel with said condition sensor and responsive to a second predetermined unsafe condition to generate a said override safety signal, said safety override sensor being connected with said transmitter.

12. Transmitter apparatus according to claim 1 wherein:

said condition sensor is in the form of a feeler wand for detecting the distance some part of said cargo transport is from the ground; and said lock out switch means is in the form of a mercury switch responsive to selected inclination of said cargo transport to operate said lock out switch.

13. Transmitter apparatus for mounting on a truck to sense an unsafe condition and responsive thereto to generate an operational signal and comprising;

a housing for mounting on said truck in a predetermined orientation;

a condition sensor responsive to a predetermined unsafe condition to generate a safety signal;

a transmitter responsive to said safety signal to generate an operational signal; and a safety override sensor connected in parallel with said condition sensor and responsive to a second predetermined unsafe condition to generate said safety signal, said safety override sensor being connected with said transmitter.

14. Safety apparatus for controlling operation of a lifting crane in response to an unsafe condition occurring in one of a plurality of trucks transporting cargo to or from said crane to deactuate an electrical control circuit controlling electrical power to a lifting mechanism attachable to the cargo transported on said trucks to a work location beneath said crane and comprising:

condition sensors mounted on the respective said trucks responsive to said unsafe condition to generate respective safety signals;

transmitters connected in circuit with the respective said condition sensors and responsive to said respective safety signals to generate respective operational signals;

a disable switch to be mounted on said crane in circuit with said electrical control circuit and responsive to said operational signal to open said control circuit and stop said lifting mechanism;

a crane isolation sensor for sensing the location of said crane and in response to disposition of said crane over said work area to generate a safety arming signal;

a receiver including logic circuit connected between said disable switch and isolation sensor to normally block communication of said operational signal to said disable switch and operative in response to said arming signal to communicate said operational signal to said disable switch.

15. Safety apparatus as set forth in claim 14 wherein:

said transmitters are operative to generate the respective said operational signals of a predetermined characteristic;

said receiver is operative in response to said operational signal of said predetermined characteristic; and said apparatus includes an interference receiver connected in circuit with said receiver logic circuit and operative in response to a transmission signal of a selected characteristic different than said predetermined characteristic to generate an interference alarm.

16. Safety apparatus as set forth in claim 14 that includes:

an alarm operative in response to said operational signal from said receiver logic circuit to generate an alarm signal.

17. Safety apparatus as set forth in claim 14 that includes:

two of said receiver logic circuits, one for mounting on either side of said crane and connected to said disable switch in parallel whereby each of said receiver logic circuits is operative to deactuate said switch in response to said operational signal.

18. Safety apparatus as set forth in claim 14 wherein:

said transmitter includes a signal identifier for introducing an identification characteristic into said operational signal whereby said transmitter produces said operational signal with said identification characteristic; and said receiver logic circuit includes a signal recognizer responsive to said identification characteristic in said operational signal to communicate said operational signal to said disable switch and actuate said alarm.

19. Safety apparatus as set forth in claim 14 that includes:

an override switch connected in circuit with said disable switch to, upon actuation, override said disable switch.

20. Safety apparatus for controlling operation of a transfer device in response to a predetermined condition in one of a plurality of cargo transports transporting cargo to or from said transfer device to interrupt an electrical circuit controlling electrical power to said transfer device and comprising:

sensors for cooperation with the respective said cargo transports and responsive to said predetermined condition to generate respective actuation signals;

transmitters connected in circuit with the respective said sensors and responsive to said actuation signals to transmit respective operational signals;

an interrupt switch mounted on said transfer device; and a switch control responsive to the respective said operational signals to actuate said interrupt switch whereby said sensors will sense said predetermined condition of any of said cargo transports to thereby generate a said actuation signal and cause said switch control to actuate said interrupt switch.

21. Safety apparatus as set forth in claim 15 for use with a lifting crane for lifting loads off cargo transport trucks and wherein:

said sensors are responsive to elevation of some part of the respective said trucks to a predetermined height to generate the respective said actuation signals; and said interrupt switch is operative to interrupt operation of said lifting crane.

* * * * *